US009326084B2

(12) United States Patent
Mosgaard

(10) Patent No.: US 9,326,084 B2
(45) Date of Patent: Apr. 26, 2016

(54) MULTI LOBE STEREO LOUDSPEAKER IN ONE CABINET

(75) Inventor: Jes Mosgaard, Skive (DK)

(73) Assignee: Libratone A/S, Skovlunde (DK)

( * ) Notice: Subject to any disclaimer, the term of this patent is extended or adjusted under 35 U.S.C. 154(b) by 43 days.

(21) Appl. No.: 14/368,055

(22) PCT Filed: Jun. 25, 2012

(86) PCT No.: PCT/DK2012/050211

§ 371 (c)(1),
(2), (4) Date: Jun. 23, 2014

(87) PCT Pub. No.: WO2013/097850

PCT Pub. Date: Jul. 4, 2013

(65) Prior Publication Data

US 2014/0348330 A1 Nov. 27, 2014

(30) Foreign Application Priority Data

Dec. 30, 2011 (DK) ..... 2011 70769

(51) Int. Cl.

| | |
|---|---|
| ***H04S 5/00*** | (2006.01) |
| ***H04R 5/02*** | (2006.01) |
| ***H04S 7/00*** | (2006.01) |
| *H04R 1/34* | (2006.01) |
| *H04R 1/40* | (2006.01) |

(52) U.S. Cl.

CPC .. *H04S 5/00* (2013.01); *H04R 5/02* (2013.01); *H04S 7/307* (2013.01); *H04R 1/345* (2013.01); *H04R 1/403* (2013.01); *H04R 2201/028* (2013.01); *H04R 2201/34* (2013.01); *H04R 2201/401* (2013.01); *H04R 2205/022* (2013.01); *H04R 2420/07* (2013.01)

(58) Field of Classification Search

None

See application file for complete search history.

(56) References Cited

U.S. PATENT DOCUMENTS

| | | | | |
|---|---|---|---|---|
| 4,182,931 | A | 1/1980 | Kenner | |
| 2007/0041599 | A1 | 2/2007 | Gauthier et al. | |
| 2009/0060251 | A1 * | 3/2009 | Maeda | H04R 7/02 381/398 |
| 2012/0300962 | A1 * | 11/2012 | Devoto | H04R 5/02 381/300 |

FOREIGN PATENT DOCUMENTS

| | | | |
|---|---|---|---|
| WO | WO 2005/004531 | A1 | 1/2005 |
| WO | WO 2007/125116 | A1 | 11/2007 |
| WO | WO 2008/081499 | A2 | 7/2008 |

OTHER PUBLICATIONS

International Search Report for PCT/DK2012/050211 dated Sep. 6, 2012.

* cited by examiner

*Primary Examiner* — Paul Huber

(74) *Attorney, Agent, or Firm* — Knobbe Martens Olson & Bear LLP

(57) ABSTRACT

A one-cabinet stereo loudspeaker, wherein at least first and second loudspeaker units (LL, LR) are arranged in a cabinet structure (CB) so as to radiate sound with at least three lobes of the first acoustic signal (L) alternating with respect to horizontal angle with at least three lobes of the second acoustic signal (R). This provides a spacious sound experience at all locations around the loudspeaker.

17 Claims, 7 Drawing Sheets

MULTI LOBE STEREO LOUDSPEAKER IN ONE CABINET

CROSS REFERENCE TO RELATED APPLICATIONS

This application is a U.S. National Phase Application of PCT International Application Number PCT/DK2012/050211, filed on Jun. 25, 2012, designating the United States of America and published in the English language, which is an International Application of and claims the benefit of priority to Danish Patent Application No. PA 2011 70769, filed on Dec. 30, 2011. The disclosures of the above-referenced applications are hereby expressly incorporated by reference in their entireties.

FIELD OF THE INVENTION

The present invention relates to the audio devices, more specifically the invention provides a one cabinet loudspeaker for reproduction of stereo audio signals.

BACKGROUND OF THE INVENTION

A compact one-cabinet stereo loudspeaker normally provides a very limited listening window right in front of the loudspeaker where a spacious sound experience of a stereo audio signal can be enjoyed. Listening to such loudspeaker from other directions will provide a sound experience as listening to a mono sound source.

SUMMARY OF THE INVENTION

It may be seen as an object of the present invention to provide a one-cabinet loudspeaker capable of providing reproduction of stereo audio signals which provides a spacious sound experience from positions all around the loudspeaker, thus allowing the loudspeaker to be placed in the middle of a room.

The invention provides a loudspeaker arranged to receive an input signal with first and second channels and to generate respective first and second acoustic signals accordingly, the loudspeaker comprising at least a first and a second loudspeaker units arranged to generate respective first and second acoustic signals in accordance with the first and second channels, wherein the at least first and second loudspeaker units are arranged in a cabinet structure so as to radiate sound with at least three lobes of the first acoustic signal alternating with respect to horizontal angle with at least three lobes of the second acoustic signal.

Such loudspeaker is advantageous, since it allows reproduction of stereo audio signals with a horizontally angular radiation pattern with alternating left and right channel lobes, preferably covering 360°. Hereby, a spacious sound experience can be obtained in practically all positions around the loudspeaker. Thus, when placed in a room, the loudspeaker can generate spacious stereo sound all over the room, even though the dimensions of the loudspeaker in itself if very small and without the normally required spacing of loudspeaker units for playing left and right stereo channels. The at least three alternating left and right may especially be angularly distributed to cover the full 360° horizontally and thus allow spacious sound to be perceived in any position around the loudspeaker.

As will be appreciated in the following, the loudspeaker according to the invention can be implemented with only two loudspeaker units where reflecting parts of the cabinet structure serve to distribute the acoustic signals from the two loudspeaker units in horizontal directions in a pattern so as to provide the at least three alternating left and right lobes. Alternatively, separate loudspeaker units may be used to generate the individual lobes, e.g. six separate loudspeaker units each with narrow directive radiation patterns in the horizontal plane and arranged in or on the cabinet structure such that they point in different horizontal directions.

Since the most directional information in an audio signal is above 500 Hz, it is appreciated that the most important frequency ranged to provide the at least three lobes of the first acoustic signal alternating with respect to horizontal angle with at least three lobes of the second acoustic signal, is the frequency range 1-10 kHz. Thus, in some embodiment, the at least first and second loudspeaker units and/or part of the cabinet structure are arranged such that the at least three lobes of the first acoustic signal alternating with respect to horizontal angle with at least three lobes of the second acoustic signal are generated at least for frequencies above a lower limit frequency, such as above a lower limit frequency of 1 kHz, 2 kHz, 3 kHz, 4 kHz, or 5 kHz, 6 kHz, 7 kHz, 8 kHz, 9 kHz, or 10 kHz.

In preferred embodiments, the loudspeaker is battery powered and arranged to receive the input signal in a wireless form, e.g. over a Wi-Fi network, and thus the loudspeaker is suited for position in the centre of a room without the need for any connection cables. Further, in embodiments capable of acting as a Wi-Fi access point, the loudspeaker may be used outside Wi-Fi network coverage, e.g. in the garden or on the beach, where the user can stream music to the loudspeaker from a smart phone, a tablet, or a laptop computer or the like.

Preferably, said two sets of at least three lobes of respective first and second acoustic signals are spread with respect to horizontal angle, so as to cover a wide horizontal angular window, most preferably 360°. In preferred embodiments, the loudspeaker is arranged to radiate sound with at least four, such as five, six, seven or eight lobes of the first acoustic signal alternating with respect to horizontal angle with at four, such as five, six, seven or eight lobes of the second acoustic signal.

In some embodiments, the at least first and second loudspeaker units and/or part of the cabinet structure are arranged such that lobes of the first acoustic signal and lobes of the second acoustic signal each have a horizontal direction pattern such that neighbouring lobes of the first and second acoustic signals are non-overlapping. However, there may be an overlap by 10-30% of a horizontal angular extension of each of the neighbouring lobes of the first and second acoustic signals. Most preferably, above a certain frequency, e.g. above 2-6 kHz, the lobes are substantially non-overlapping, e.g. an overlap of less than 10% of a horizontal angular extension of neighbouring lobes. A gradually higher overlap between neighbouring lobes towards lower frequencies can be provided, or it may even be preferred, e.g. such that the loudspeaker generates a pure mono signal below a certain frequency, such as below 100-800 Hz.

The at least first and second loudspeaker units and/or part of the cabinet structure may be are arranged such that the at least three lobes of the first acoustic signal alternating with respect to horizontal angle with at least three lobes of the second acoustic signal are generated at least for frequencies above a lower limit frequency, such as above a lower limit frequency of 1 kHz, 2 kHz, 3 kHz, 4 kHz, or 5 kHz, 6 kHz, 7 kHz, 8 kHz, 9 kHz, or 10 kHz. Especially, the loudspeaker may comprise one or more further loudspeaker units arranged to receive an electric signal based on at least one of the first and second channels, wherein the one or more further loudspeaker units is/are arranged in relation to the cabinet structure to generate acoustic signals above the lower limit frequency with a different horizontal direction pattern, such as with a direction pattern which is uniform or substantially uniform in a horizontal plane.

Preferably, the loudspeaker comprises power amplifiers arranged to drive the at least first and second loudspeaker units, thus allowing an active stand-alone stereo-loudspeaker.

Preferably, the loudspeaker comprises a re-chargeable battery located within the cabinet structure, wherein the rechargeable battery is arranged to power all power demanding circuits of the loudspeaker.

Preferably, the loudspeaker comprises a wireless receiver arranged to receive the input signal with first and second channels represented in a Radio Frequency signal, wherein the wireless receiver is arranged within the cabinet structure, such as a wireless receiver arranged to receive the input signal with first an second channels from a Wi-Fi network. Alternatively, or additionally, the loudspeaker may include a Bluetooth receiver for receiving the input signal.

Especially, the loudspeaker may be arranged to function as a Wi-Fi access point, thus allowing streaming of music from a portable Wi-Fi device in environment without Wi-Fi network coverage, such as outdoor.

It is to be understood that the invention can be implemented in various ways. Preferred embodiments are deined in the dependend claims, and in the description in the following.

BRIEF DESCRIPTION OF THE FIGURES

Embodiments of the invention will be described in more detail in the following with regard to the accompanying figures. The figures show one way of implementing the present invention and is not to be construed as being limiting to other possible embodiments falling within the scope of the attached claim set.

DETAILED DESCRIPTION OF EMBODIMENTS

Figure 1:
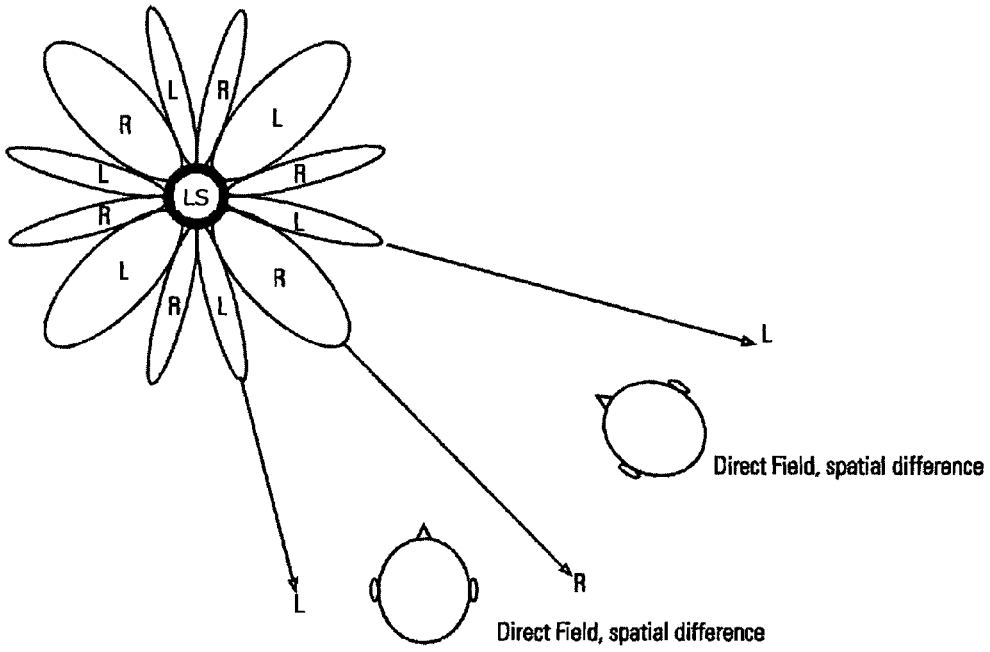
FIG. 1 shows a sketch of a horizontal sound radiation pattern of the two stereo channels radiated from a one-cabinet stereo loudspeaker embodiment.

FIG. 1 shows a one-cabinet loudspeaker LS with at least two loudspeaker units provided with respective left and right electric stereo audio signals. The at least two loudspeaker units are arranged in a cabinet configuration such that they generate respective left and right channel acoustic signal lobes L, R in a horizontal radiation pattern where the left and right channel lobes L, R are alternating with respect to horizontal angle, in the shown embodiment 6 left channel lobes L and 6 right channel lobes R. The two heads show two listener positions at different locations around the loudspeaker. In one location, left signal L is perceived to the left and right signal R to the right. However, in a slightly different location, the right signal R is perceived to the left and left signal L to the right. Nevertheless, a spacious sound experience can be experienced in practically all locations around the loudspeaker.

As shown, two opposite directed main left channel lobes L (the widest lobes) and two opposite directed main right channel lobes R (the widest lobes) occupy larger horizontal angle windows than the remaining minor left and right lobes L, R. However, in other embodiments all lobes may have equal horizontal widths.

Figure 2:
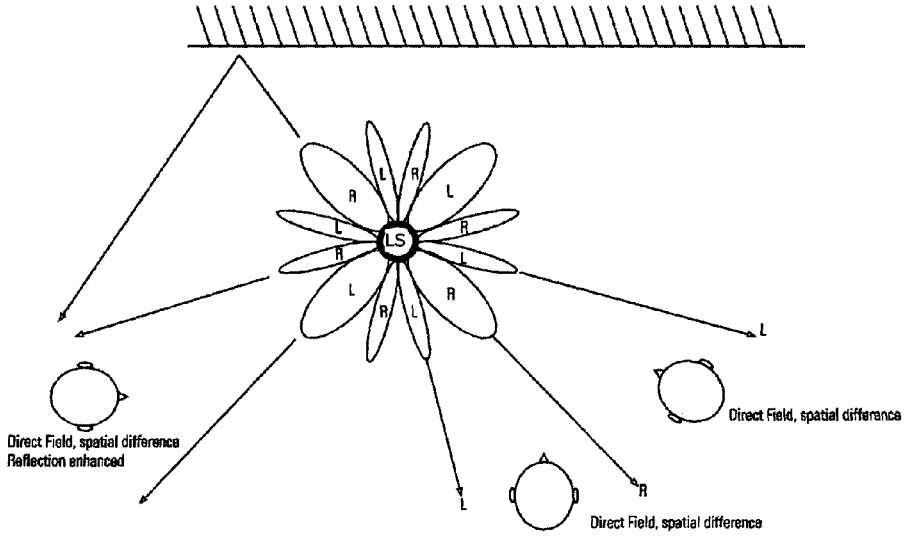
FIG. 2 shows a sketch of the same horizontal sound radiation pattern as in FIG. 1, but where the loudspeaker is placed near a reflecting wall.

FIG. 2 illustrates the same loudspeaker LS with the same radiation pattern of left lobes L and right lobes R, but here illustrated placed near a reflecting wall. Still, a spacious sound experience can be obtained in practically all locations, and the reflection from the wall will even serve to enhance the spacious sound experience.

Figure 3:
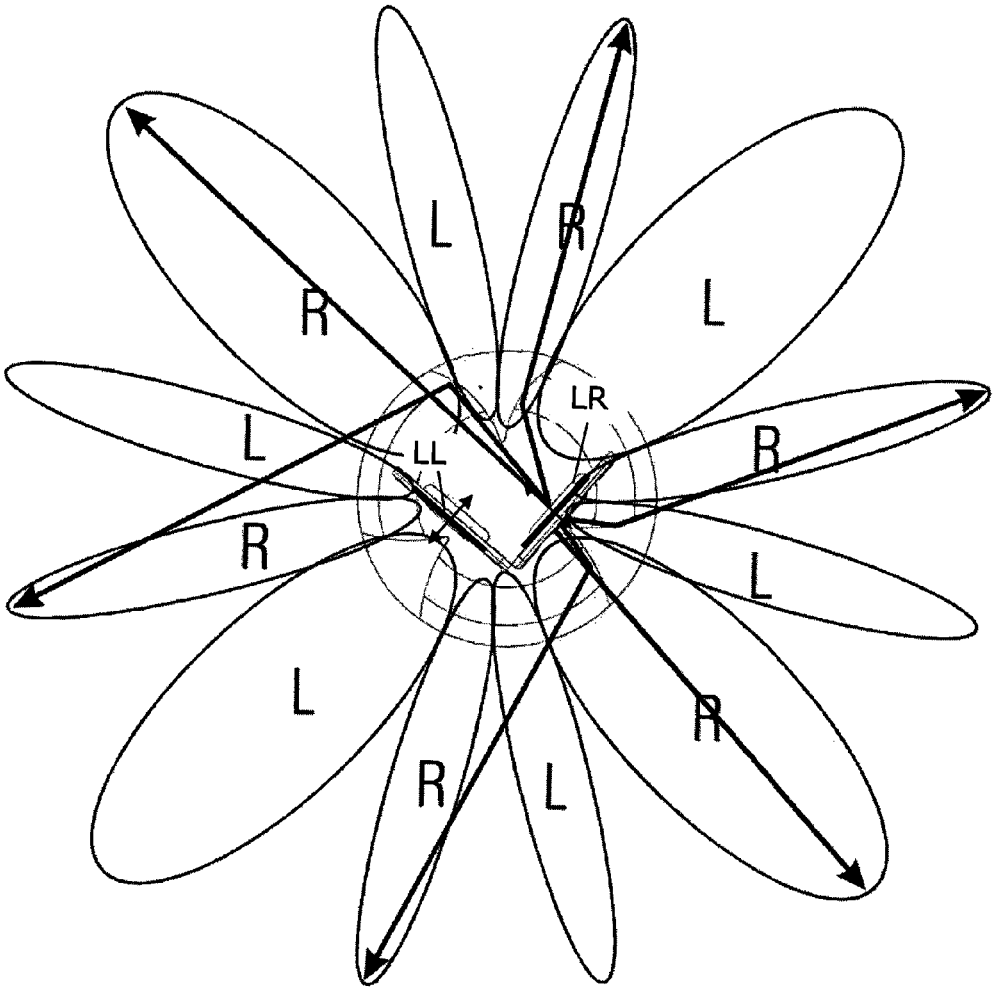
FIG. 3 shows a sketch of an example of a configuration of two dipole radiating loudspeaker units and reflecting surfaces to provide the desired horizontal sound radiation pattern.

FIG. 3 shows on possible implementation of the radiation patterns shown in FIGS. 1 and 2, seen from above. Two loudspeaker units LL, LR generate respective left and right channel signals L, R. The two loudspeaker units LL, LR are dipole radiators, e.g. planar type or air motion type loudspeaker units. The double arrows indicate the movements of their diaphragms. The two units LL, LR are closely spaced and arranged with their diaphragms in a vertical plane, and horizontally angled 90° in relation to each other. Vertical radiating structures are arranged around the two loudspeaker units LL, LR to provide acoustically reflecting surfaces serving to radiate the dipole signals away from the loudspeaker units LL, LR and away from the cabinet to provide the horizontally alternating left and right channel lobes L, R. The arrows indicate how the right channel lobes are generated. The two opposite directed main lobes are direct sound from respective sides of the diaphragm of the loudspeaker unit, while the four minor lobes are generated by reflections on the reflecting structures.

Figure 4:
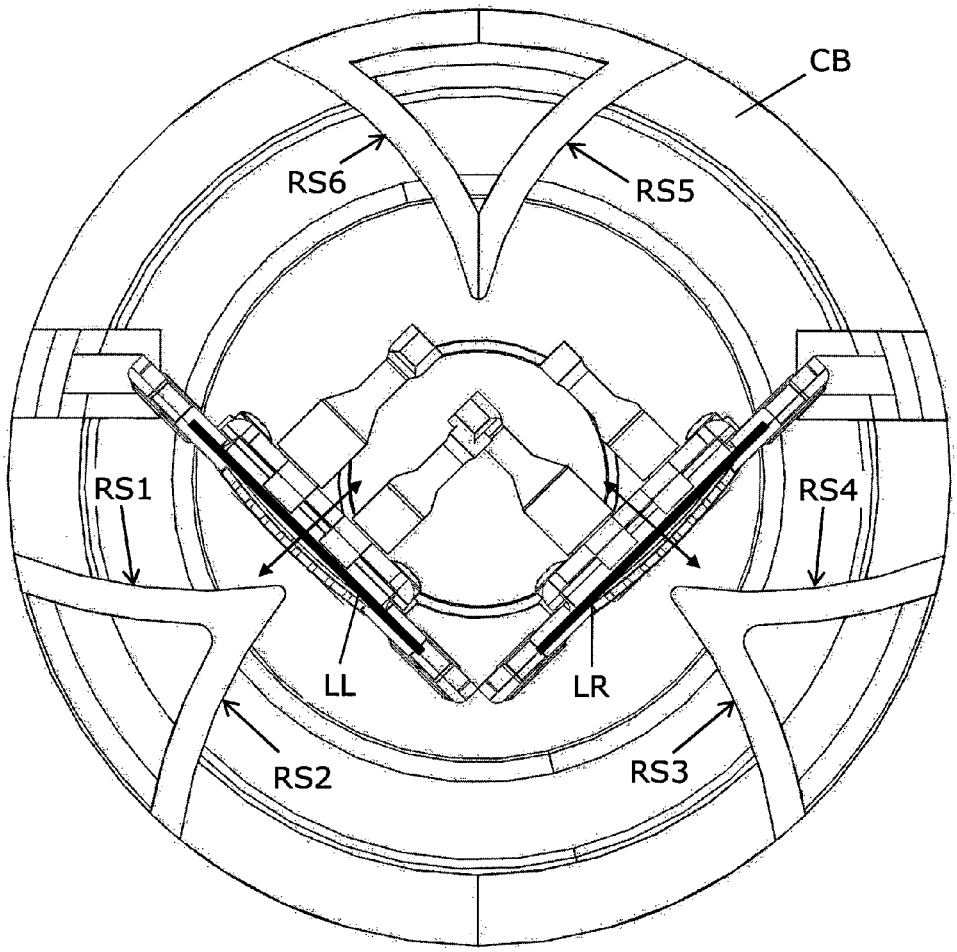
FIG. 4 shows a more detailed sketch of the configuration of FIG. 3.

FIG. 4 shows a more detailed view of a possible implementation of the principle shown in FIG. 3. Six slightly curved reflecting surfaces RS1-6 are provided as part of the cabinet CB structure, e.g. provided by a polymeric or metallic structures.

Figure 5:
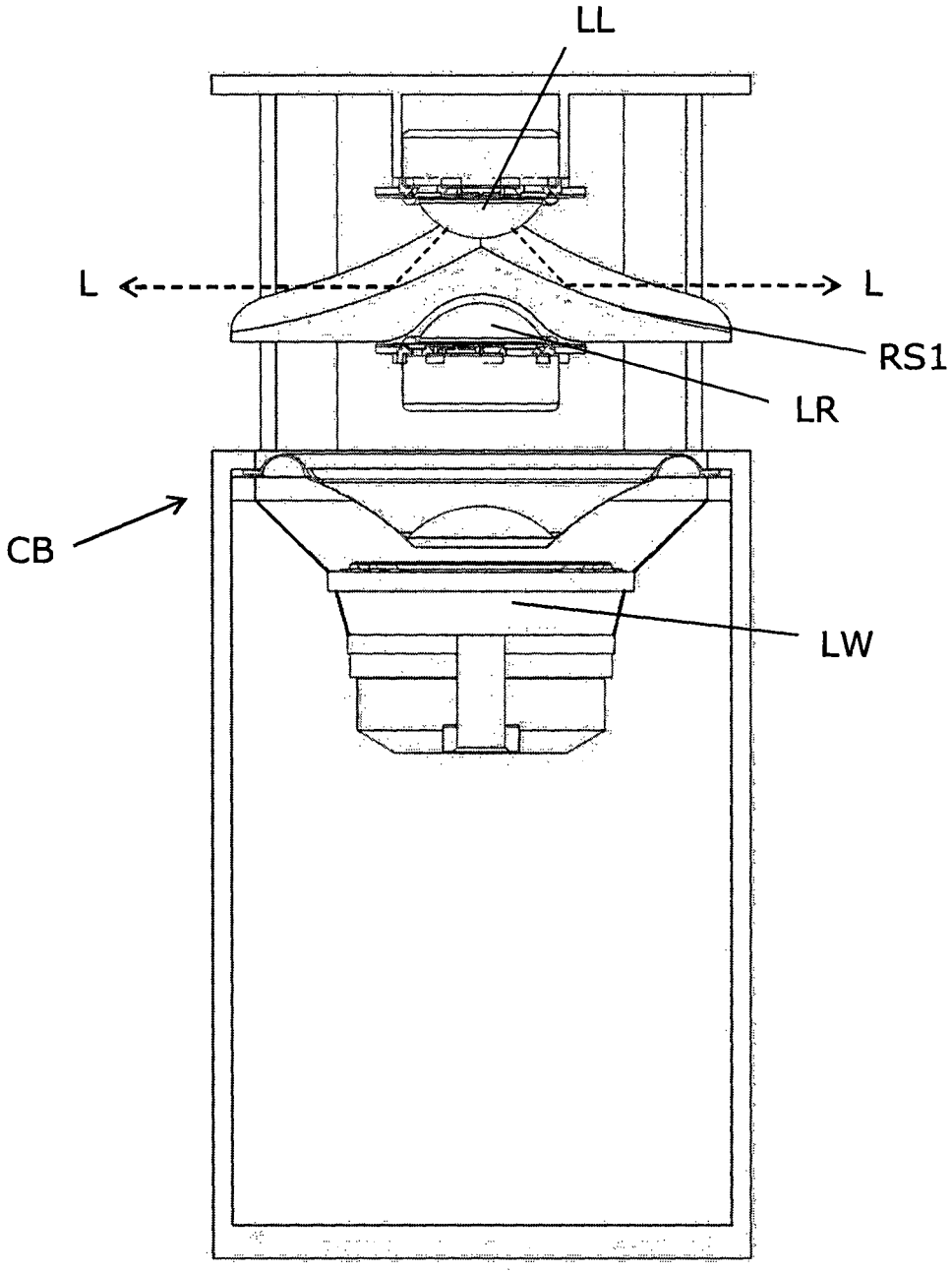
FIG. 5 shows a side section sketch of another example of a configuration of two dome tweeters arranged on the same vertical axis and with an intermediate reflecting structure.

FIG. 5 shows a section view of another embodiment where the left and right channel loudspeaker units LL, LR are implemented as monopole units, namely traditional dome tweeters. The two dome tweeters LL, LR are placed on the same vertical axis, here also the center axis of the cylindrical cabinet CB. The two loudspeaker units are oriented such that they radiate sound in opposite vertical directions, namely towards each other. An intermediate multicurved reflecting structure RS1 serves to direct sound horizontally away from the loudspeaker units LL, LR to provide the horizontal radiation patterns as illustrated in FIGS. 1 and 2. The dashed arrows indicate for two directions how sound L is reflected at RS1 from the upper, left channel loudspeaker unit LL. A woofer LW is placed in an enclosure in the lower part of the cabinet and serves to reproduce audio signal in mono at lower audio frequencies, e.g. dividing frequency to the two dome tweeters of such as within 1-5 kHz.

The embodiment may be dimensioned such as to a cabinet height of such as 20-40 cm high, but in other versions, the height may be 40-60 cm or even higher.

Figure 6:
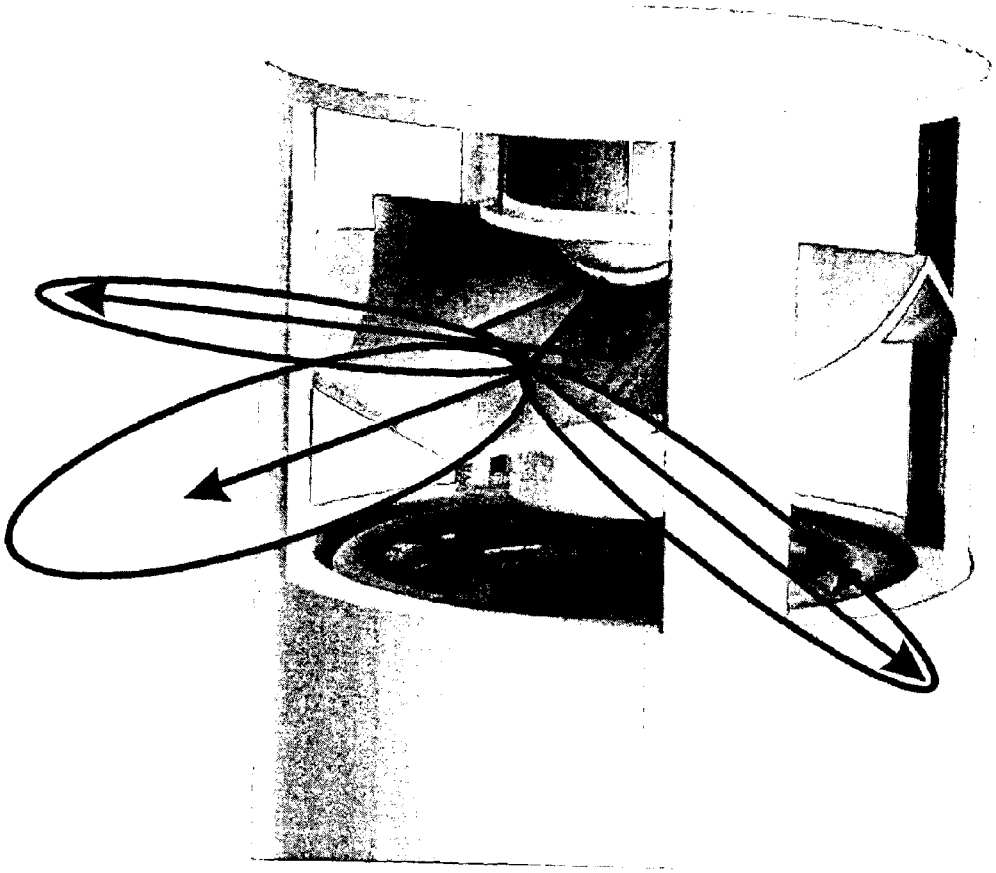
FIG. 6 shows a 3D view of the embodiment of FIG. 5, FIG. 7*a-d* show example of different left and right lobe patterns with different sets of left and right lobe pairs.

FIG. 6 shows a 3D view of the embodiment of FIG. 5, where the arrows indicated three reflection directions, i.e. three horizontal lobes, from the upper dome tweeter by means of reflections of different portions of the multicurved reflection structure placed between the dome tweeters. This reflection structure is seen as implemented by curved place of a polymeric or metallic material. The steepness and direction of the reflecting structure is understood to define the broadness and direction of the horizontal lobes. The reflection structure should be shaped to meet the desired properties with respect to both horizontal and vertical width of the single lobes, e.g. by means of simulation tools, such as known by the skilled person.

Figure 7A:
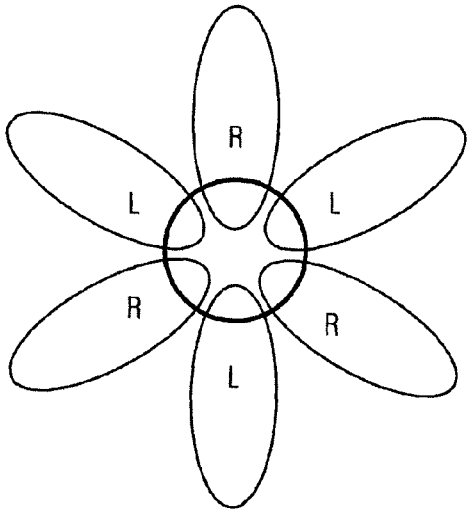
Figure 7B:
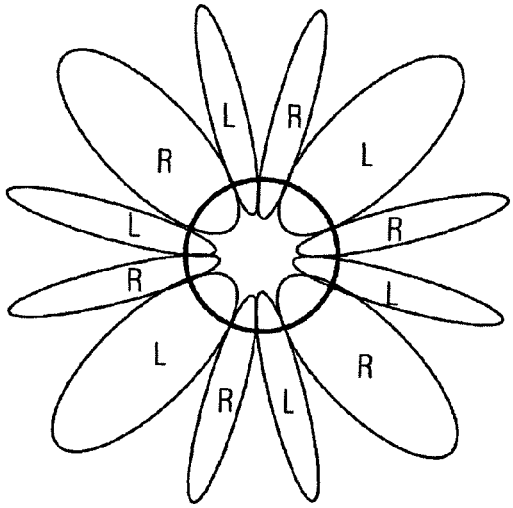
Figure 7C:
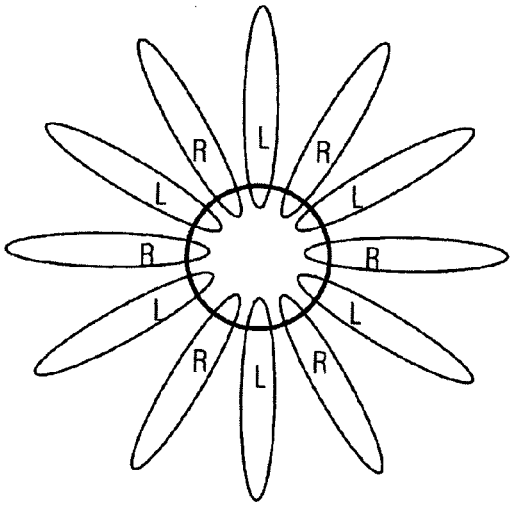
Figure 7D:
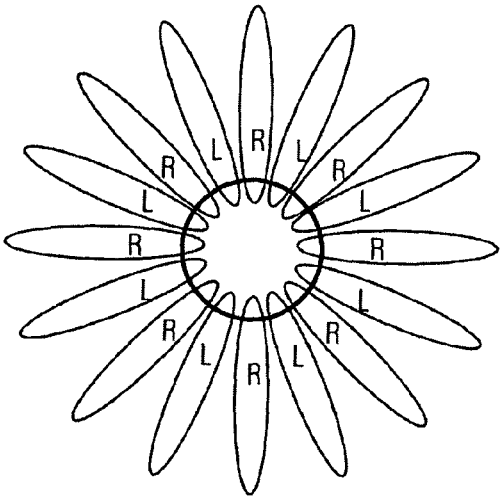

FIGS. 7*a-d* illustrate examples of different radiation patterns from loudspeaker embodiments, where two or more loudspeaker units and reflecting cabinet parts serve to distribute left L and right R channel audio signals in non-overlapping different horizontal directions. FIG. 7*a* shows a horizontal radiation pattern.

Figure 8:
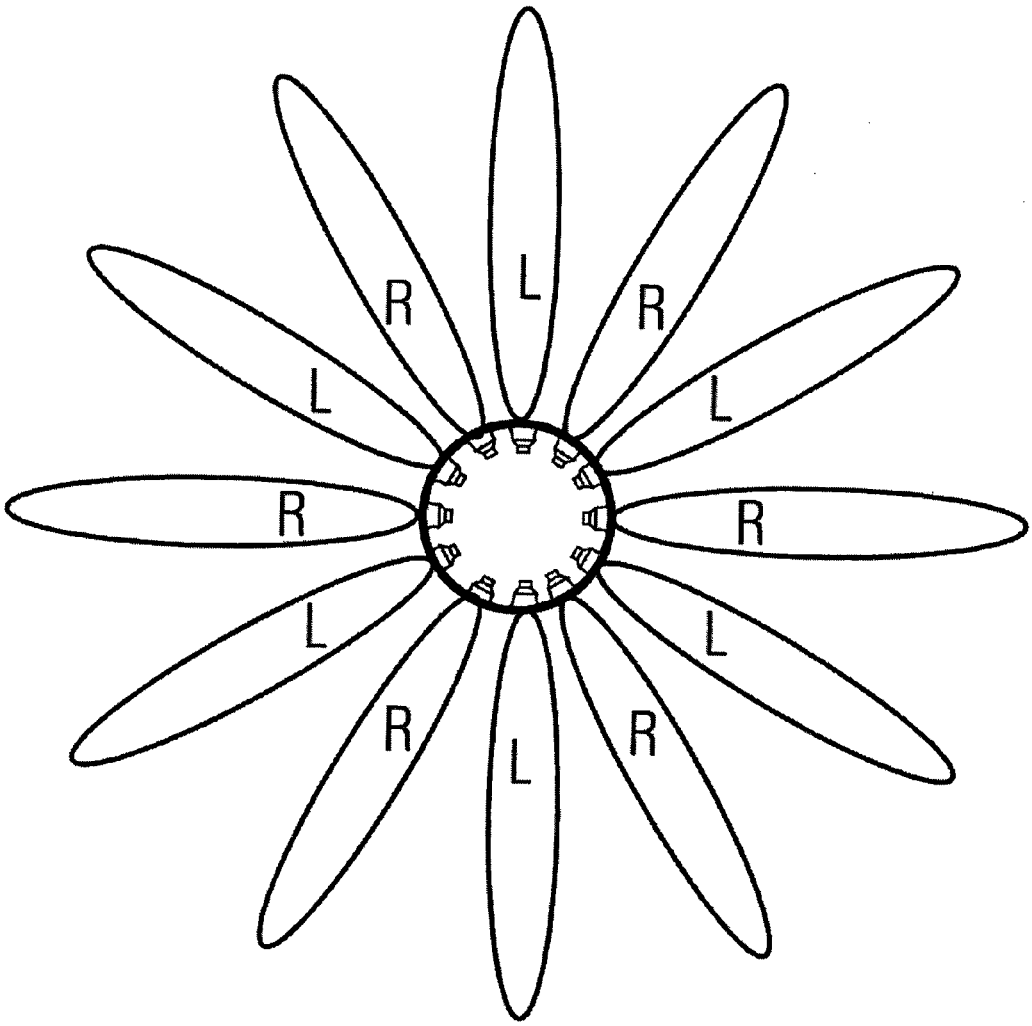
FIG. 8 shows and embodiment with separate directive loudspeaker units generating each of a number of left and right lobes.

FIG. 8 illustrate an embodiment, where the horizontally distributed left L and right R lobes are generated by respective loudspeaker units. I.e. one loudspeaker unit for each lobe, here the number of loudspeaker units illustrated is 12, namely 6 for left lobes L and six for right lobes R. The loudspeaker units may themselves have a narrow horizontal radiation pattern, or they may be mounted in a part of the cabinet structure which provide such narrowing of the resulting radiation pattern from each of the loudspeaker units. Especially, the loudspeaker units may be dome tweeters.

To sum up, the invention provides a one-cabinet stereo loudspeaker, wherein at least first and second loudspeaker units are arranged in a cabinet structure so as to radiate sound with at least three lobes of the first acoustic signal alternating with respect to horizontal angle with at least three lobes of the second acoustic signal. This provides a spacious sound experience at all locations around the loudspeaker.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A loudspeaker arranged to receive an input signal with first and second channels and to generate respective first and second acoustic signals accordingly, the loudspeaker comprising at least a first and a second loudspeaker units arranged to generate respective first and second acoustic signals in accordance with the first and second channels, wherein the at least first and second loudspeaker units are arranged in a cabinet structure so as to radiate sound with at least three lobes of the first acoustic signal alternating with respect to horizontal angle with at least three lobes of the second acoustic signal, wherein the at least first and second loudspeaker units and/or part of the cabinet structure are arranged such that lobes of the first acoustic signal and lobes of the second acoustic signal each have a horizontal direction pattern such that neighbouring lobes of the first and second acoustic signals overlap by a maximum of 10% of a horizontal angular extension of each of the neighbouring lobes of the first and second acoustic signals.

2. The loudspeaker according to claim 1, wherein said two sets of at least three lobes of respective first and second acoustic signals are spread with respect to horizontal angle, so as to cover a horizontal angular window of at least 180°.

3. The loudspeaker according to claim 1, arranged to radiate sound with at least four lobes of the first acoustic signal alternating with respect to horizontal angle with at least four lobes of the second acoustic signal.

4. The loudspeaker according to claim 1, comprising a plurality of reflecting surfaces spatially positioned in relation to the first and second loudspeaker units and oriented so as to direct the first and second acoustic signals away from the cabinet structure in order to radiate sound with said at least three lobes of respective first and second acoustic signals.

5. The loudspeaker according claim 1, wherein the first and second loudspeaker units are monopole loudspeaker units arranged to generate the respective first and second acoustic signals as acoustic monopole signals.

6. The loudspeaker according to claim 5, wherein the first and second loudspeaker units are oriented to direct sound in opposite directions.

7. The loudspeaker according to claim 5, wherein the first and second loudspeaker units are centered around the same or substantially the same vertical axis.

8. The loudspeaker according to claim 1, comprising a plurality of loudspeaker units arranged to generate the first acoustic signal, and a plurality of loudspeaker units arranged to generate the second acoustic signal.

9. The loudspeaker according to claim 1, wherein the first and second loudspeaker units are arranged to cover audio frequencies between 10 kHz down to at least 5 kHz.

10. The loudspeaker according to claim 1, comprising a third loudspeaker unit arranged within the cabinet structure, wherein the third loudspeaker unit is arranged to generate audio frequencies at lower frequencies than the first and second loudspeaker units.

11. The loudspeaker according to claim 1, wherein an overall shape of the cabinet is cylindrical, and wherein the first and second loudspeaker units are both arranged near one end of the cabinet.

12. The loudspeaker according to claim 1, wherein the at least first and second loudspeaker units and/or part of the cabinet structure are arranged such that lobes of the first acoustic signal and lobes of the second acoustic signal each have a horizontal direction pattern such that neigbouring lobes of the first and second acoustic signals are non-overlapping.

13. The loudspeaker according to claim 1, wherein the at least first and second loudspeaker units and/or part of the cabinet structure are arranged such that the at least three lobes of the first acoustic signal alternating with respect to horizontal angle with at least three lobes of the second acoustic signal are generated at least for frequencies above a lower limit frequency.

14. The loudspeaker according to claim 13, comprising one or more further loudspeaker units arranged to receive an electric signal based on at least one of the first and second channels, wherein the one or more further loudspeaker units is/are arranged in relation to the cabinet structure to generate acoustic signals above the lower limit frequency with a different horizontal direction pattern, such as with a direction pattern which is uniform or substantially uniform in a horizontal plane.

15. The loudspeaker according to claim 1, comprising power amplifiers arranged to drive the at least first and second loudspeaker units.

16. The loudspeaker according to claim 1, comprising a re-chargeable battery located within the cabinet structure, wherein the re-chargeable battery is arranged to power all power demanding circuits of the loudspeaker.

17. The loudspeaker according to claim 1, comprising a wireless receiver arranged to receive the input signal with first and second channels represented in a Radio Frequency signal, wherein the wireless receiver is arranged within the cabinet structure, and wherein the loudspeaker is arranged to function as a Wi-Fi access point.

* * * * *